US010914507B2

(12) United States Patent
Karl

(10) Patent No.: US 10,914,507 B2
(45) Date of Patent: Feb. 9, 2021

(54) APPLIANCE BIN

(71) Applicant: WHIRLPOOL CORPORATION, Benton Harbor, MI (US)

(72) Inventor: Jackson F. Karl, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 62 days.

(21) Appl. No.: 15/614,940

(22) Filed: Jun. 6, 2017

(65) Prior Publication Data

US 2018/0347893 A1 Dec. 6, 2018

(51) Int. Cl.

| | |
|---|---|
| ***F25D 23/02*** | (2006.01) |
| ***F25D 23/04*** | (2006.01) |
| ***F25D 11/00*** | (2006.01) |
| ***A47B 49/00*** | (2006.01) |

(52) U.S. Cl.

CPC ..... *F25D 23/04* (2013.01); *A47B 49/002* (2013.01); *F25D 11/00* (2013.01); *F25D 23/025* (2013.01); *F25D 2323/021* (2013.01); *F25D 2323/023* (2013.01)

(58) Field of Classification Search

CPC ..... F25D 23/04; F25D 23/025; F25D 23/028; F25D 25/02

See application file for complete search history.

(56) References Cited

U.S. PATENT DOCUMENTS

| | | | | |
|---|---|---|---|---|
| 261,027 | A * | 7/1882 | Nettleton | A47B 49/002 312/328 |
| 2,573,272 | A | 10/1951 | Petkwitz | |
| 2,694,906 | A * | 11/1954 | Didion | F25D 23/12 62/326 |
| 2,784,047 | A * | 3/1957 | Wallance | A47B 49/002 312/328 |
| 4,333,588 | A * | 6/1982 | Schreck | F25C 5/22 222/164 |
| 4,732,435 | A | 3/1988 | Bailey et al. | |
| 4,834,557 | A | 5/1989 | Dreinhoff | |
| 4,998,382 | A | 3/1991 | Kostos et al. | |
| 5,524,981 | A | 6/1996 | Herrmann et al. | |
| 5,660,777 | A | 8/1997 | Herrmann et al. | |
| 5,918,959 | A | 7/1999 | Lee | |
| 5,954,413 | A * | 9/1999 | Brown | A47B 46/005 292/145 |
| 6,045,101 | A | 4/2000 | Goyette et al. | |
| 6,742,855 | B2 * | 6/2004 | Whitaker | F25D 23/04 312/321.5 |

(Continued)

FOREIGN PATENT DOCUMENTS

| | | |
|---|---|---|
| CN | 202432813 U | 9/2012 |
| CN | 203216196 U | 9/2013 |

(Continued)

*Primary Examiner* — Kimberley S Wright
(74) *Attorney, Agent, or Firm* — Price Heneveld LLP

(57) ABSTRACT

A refrigerated appliance is provided herein. The refrigerated appliance includes a cabinet defining a compartment. A first door is coupled to the cabinet. The first door defines a storage chamber therein. A second door is disposed on an opposing side of the first door from the cabinet. A bin is disposed within the chamber. A bracket is disposed between the first door and the bin. The bracket includes a rotatable member to rotate the bin between first and second positions.

18 Claims, 10 Drawing Sheets

(56) References Cited

U.S. PATENT DOCUMENTS 6,811,045 B1 11/2004 Masker et al.
6,908,163 B1 * 6/2005 Hebeler ..... F25D 23/04 312/321.5
7,232,194 B2 6/2007 Becke et al.
7,350,886 B2 * 4/2008 Antos ..... A47B 46/00 312/404
7,651,182 B2 1/2010 Eveland et al.
7,748,806 B2 7/2010 Egan
8,147,016 B2 * 4/2012 Kwon ..... F25D 25/02 312/321.5
8,336,976 B2 * 12/2012 Lee ..... F25D 23/04 312/405.1
8,348,362 B2 1/2013 Candeo et al.
8,414,095 B2 4/2013 Stewart
D710,406 S 8/2014 Seo et al.
8,833,882 B2 * 9/2014 Seo ..... F25D 23/04 312/321.5
8,864,252 B1 * 10/2014 Rodriguez Cobas ... F25D 23/04 312/321.5
8,925,696 B2 * 1/2015 Zeilenga ..... F16F 9/12 188/290
9,033,437 B2 5/2015 Klitzing et al.
9,097,457 B2 8/2015 Kim
9,127,878 B2 9/2015 Gossens et al.
9,234,690 B2 1/2016 McCollough et al.
9,250,010 B2 2/2016 De La Garza et al.
9,328,955 B2 * 5/2016 Castro Solis ..... F25D 25/025
9,339,993 B2 5/2016 Cites et al.
9,488,405 B2 11/2016 Lee et al.
9,500,403 B2 11/2016 Seo et al.
9,702,614 B2 * 7/2017 Lim ..... F25D 23/025
9,903,641 B1 * 2/2018 Shrader ..... F25D 23/04
10,113,789 B2 * 10/2018 Yu ..... F25D 25/027
10,371,436 B2 * 8/2019 Kumar ..... F25D 25/025
2002/0117947 A1 * 8/2002 Cheng ..... A47B 87/008 312/327
2003/0102787 A1 * 6/2003 Whitaker ..... F25D 23/04 312/405.1
2004/0012314 A1 1/2004 Hay et al.
2005/0073227 A1 * 4/2005 Shin ..... F25D 23/04 312/404
2006/0061247 A1 * 3/2006 Lee ..... F25D 23/04 312/404
2006/0145577 A1 7/2006 Daley et al.
2007/0113578 A1 5/2007 Wu et al.
2007/0126325 A1 6/2007 Gorz et al.
2007/0228904 A1 * 10/2007 Williams ..... A47B 46/005 312/327
2007/0235397 A1 10/2007 Wannop
2010/0024464 A1 2/2010 Hwang et al.
2010/0270902 A1 * 10/2010 Kim ..... F25D 17/042 312/405.1
2010/0283368 A1 * 11/2010 Lee ..... F25D 23/04 312/405.1
2011/0080083 A1 * 4/2011 Engel ..... F25D 23/02 312/405
2011/0187255 A1 * 8/2011 Ryu ..... F25D 23/028 312/405
2013/0033163 A1 * 2/2013 Kang ..... F25D 23/025 312/405.1
2013/0081423 A1 * 4/2013 Kwon ..... F25D 23/028 62/449
2013/0104590 A1 * 5/2013 Seo ..... F25D 23/04 62/340
2013/0119844 A1 * 5/2013 Seo ..... F25D 23/04 312/404
2013/0119846 A1 * 5/2013 Seo ..... F25D 23/04 312/404
2013/0147337 A1 6/2013 Lim
2014/0312758 A1 * 10/2014 Gossens ..... F25D 23/04 312/404
2015/0034668 A1 2/2015 Minard et al.
2015/0061484 A1 3/2015 Jeong et al.
2015/0176887 A1 * 6/2015 Castro Solis ..... F25D 25/025 312/405.1
2015/0184929 A1 7/2015 Moon
2015/0241116 A1 * 8/2015 Choi ..... E05B 65/0042 312/404
2015/0247666 A1 * 9/2015 Kim ..... F25D 25/00 312/404
2016/0273825 A1 * 9/2016 Lim ..... F25D 23/067
2016/0290707 A1 10/2016 Burke et al.
2016/0305706 A1 * 10/2016 Lim ..... F25D 23/025
2017/0159986 A1 * 6/2017 Hong ..... F25C 1/04
2018/0149410 A1 * 5/2018 Shrader ..... F25D 25/025

FOREIGN PATENT DOCUMENTS

DE 8801508 U1 6/1989
DE 102013216974 A1 4/2014
EP 2072937 A2 6/2009
EP 2098810 A2 9/2009
EP 2431688 A1 3/2012
EP 3159635 A1 4/2017
JP H10115485 A 5/1998
JP H10122733 A 5/1998
KR 20040095421 A 11/2004
KR 20100023474 A 3/2010
KR 20130015988 A 2/2013
KR 20130016997 A 2/2013
WO 2004104504 A1 12/2004
WO 2007128734 A1 11/2007
WO 2012025382 A2 3/2012
WO 2013126515 A1 8/2013

* cited by examiner

APPLIANCE BIN

BACKGROUND

Refrigerated appliances contain various bins within a compartment thereof. In some circumstances, the refrigerated appliance may have a door-in-door configuration, and it may be desired to create bins that are accessible from either side of the bin.

BRIEF SUMMARY OF THE DISCLOSURE

According to one aspect of the disclosure, a refrigerated appliance is provided disclosed. The refrigerated appliance includes a cabinet defining a compartment. A first door is coupled to the cabinet. The first door defines a storage chamber therein. A second door is disposed on an opposing side of the first door from the cabinet. A bin is disposed within the chamber. A bracket is disposed between the first door and the bin. The bracket includes a rotatable member to rotate the bin between first and second positions.

According to another aspect of the present disclosure, a refrigerated appliance is disclosed. The refrigerated appliance includes a cabinet defining a compartment. A first door is coupled to the cabinet. The first door defines a storage chamber therein. A second door is coupled to the first door. A bin is disposed within the storage chamber and is accessible from a first side when the first door is disposed in an open position and a second side when the second door is disposed in an open position. The bin is movable between a first position and a second position.

According to yet another aspect of the present disclosure, a bin assembly is disclosed. The bin assembly includes a rotatable bin configured to be disposed within an appliance. A cavity is configured to accept a rotatable member therein. A latch is configured to maintain the bin in a predefined position. A first portion of the latch is coupled to the bin and a second portion is coupled to the appliance.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, certain examples are shown in the drawings. It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

DETAILED DESCRIPTION

As required, detailed examples of the present disclosure are disclosed herein. However, it is to be understood that the disclosed examples are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

It is to be understood that the present disclosure is not limited to the particular examples described below, as variations of the particular examples may be made and still fall within the scope of the appended claims. It is also to be understood that the terminology employed is for the purpose of describing particular examples, and is not intended to be limiting. Instead, the scope of the present disclosure will be established by the appended claims.

Figure 1:
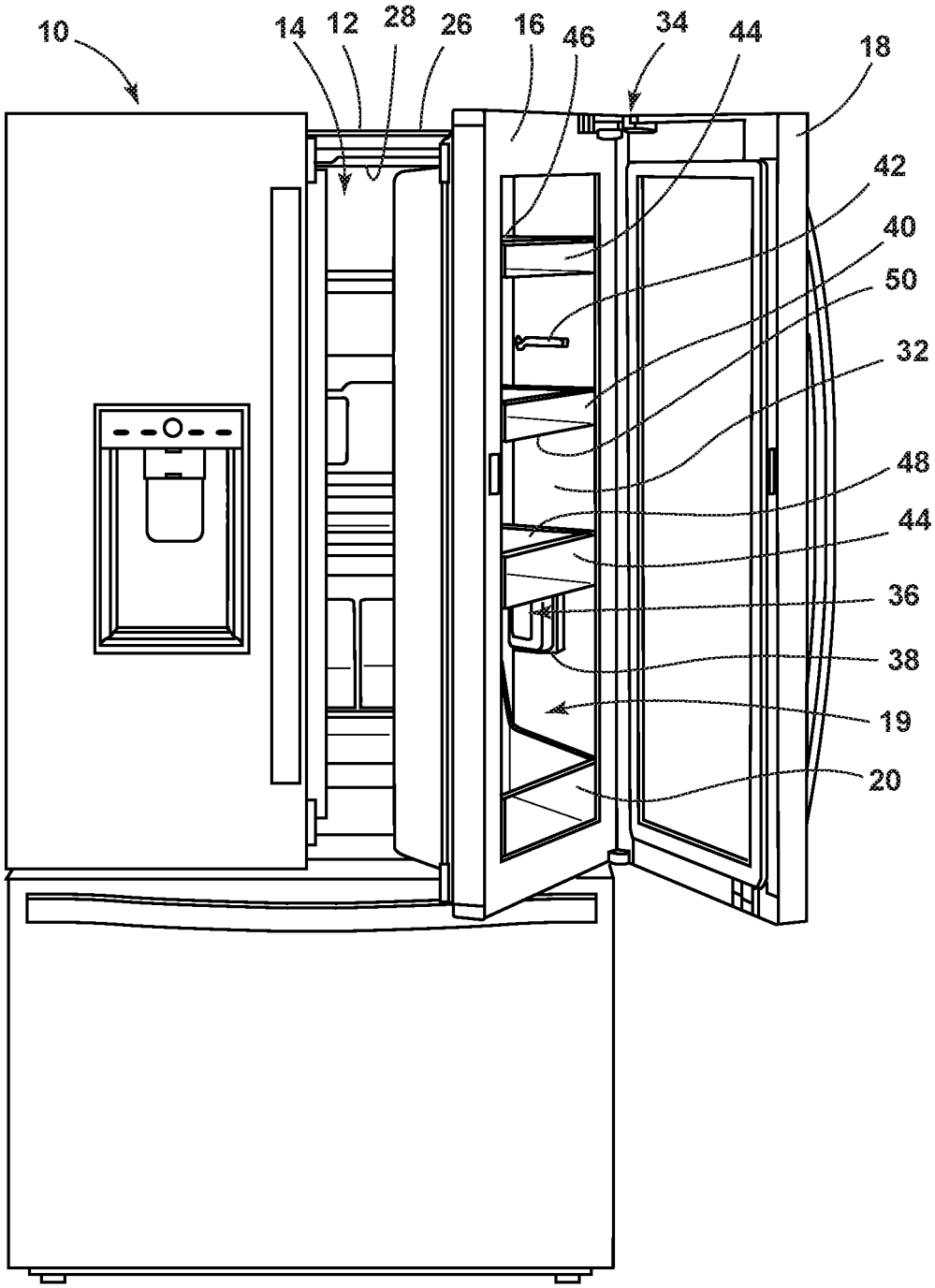
FIG. 1 is a front perspective view of a refrigerated appliance having a first door with a bin disposed therein and a second door disposed outwardly of the first door, according to some examples.

For purposes of description herein, the terms "upper," "lower," "right," "left," "rear," "front," "vertical," "horizontal," and derivatives thereof shall relate to the disclosure as oriented in FIG. 1, unless stated otherwise. However, it is to be understood that the disclosure may assume various alternative orientations, except where expressly specified to the contrary. It is also to be understood that the specific devices and processes illustrated in the attached drawings, and described in the following specification, are simply exemplary examples of the inventive concepts defined in the appended claims. Hence, specific dimensions and other physical characteristics relating to the examples disclosed herein are not to be considered as limiting, unless the claims expressly state otherwise.

Referring to FIGS. 1-11, a refrigerated appliance 10 includes a cabinet 12 defining a compartment 14. A first door 16 is coupled to the cabinet 12. The first door 16 defines a storage chamber 19 therein. A second door 18 is disposed on an opposing side of the first door 16 from the cabinet 12. A bin 20 is disposed within the chamber 19. A bracket 22 is disposed between the first door 16 and the bin 20. The bracket 22 includes a rotatable member 24 to rotate the bin 20 between first and second positions.

Referring now to FIG. 1, the cabinet 12 is formed from a wrapper 26 and a liner 28 and defines one or more compartments 14. The one or more compartments 14 may be configured as a fresh food compartment, a freezer compartment, and/or any other desired compartment known in the art. The refrigerated appliance 10 also includes a refrigeration system (not shown). The refrigeration system includes various components for generating chilled air within the one or more compartments 14, as will be understood by those skilled in the art. It will be appreciated that the one or more compartments 14 may have any suitable arrangement without departing from the scope of the present disclosure.

A first door 16 is movably coupled to the cabinet 12 to open and close the one or more compartments 14. The first door 16 includes a frame 30 (FIG. 6) and an interior door liner 32 disposed outwardly of the frame 30, among any other desired component, that defines the storage chamber 19 in the first door 16. The chamber 19 may be opened and closed by the second door 18 disposed on an opposing side of the first door 16 from the cabinet 12. The second door 18 is movably (e.g., hingedly) coupled to the first door 16 and/or the cabinet 12. Accordingly, the chamber 19 may be accessible from a first side 72 (FIG. 3) when the first door 16 is opened and the second side 74 (FIG. 2) when the second door 18 is opened.

A hinge assembly 34 may include any number of hinges that are operably coupled to the cabinet 12 and each of the doors 16, 18 in any practicable manner. The hinge assembly 34 is configured to move each door 16, 18 between the open and the closed positions to provide access to the one or more compartments 14 and/or one or more chambers 18, independently. For example, a first hinge may couple the first door 16 to the cabinet 12 while a second hinge may couple the second door 18 to the first door 16 and/or the cabinet 12. Alternatively, a single hinge may support and independently move the first and second doors 16, 18 between an open position and a closed position.

The storage chamber 19 is defined in the first door 16 and has a predetermined volume. The predefined volume may be substantially equal to the area that is bound by the interior door liner 32, the second door 18, and the front portion of the cabinet 12. In some examples, the storage chamber 19 may include a structure capable of providing cold air to the storage chamber 19 from the refrigeration system. The structure may include a duct outlet 36 and/or an air baffle 38 in communication with the storage chamber 19 such that chilled air of the refrigerated appliance 10 may be directed into any desired portion of the chamber 19.

One or more bins 20 and/or trays 40 may be disposed within the chamber 19. The trays 40 may be vertically adjustable through any means known in the art, such as, but not limited to, suspension of the trays 40 on notches 42 disposed on the interior door liner 32. The one or more bins 20 may be disposed within the chamber 19 and may be rotatable between the first position and the second, rotated position. The one or more bins 20 and/or trays 40 may be operably coupled to the duct outlet 36 to provide chilled air to items stored thereon and/or therein.

It will be understood that the refrigerated appliance 10 may take a variety of configurations, including French door, side-by-side, top freezer, bottom freezer, counter depth, compact, built-in, and/or other types of refrigerated appliances 10. The first and second doors 16, 18 may be either a refrigerated appliance door or a freezer door. Although the hinge assembly 34 is depicted as positioned on right and left sides of the refrigerated appliance 10, the hinge assembly 34 may be used on any other location (top, center, bottom, or sides). In various examples, portions of the hinge assembly 34 may be hidden or concealed using a cover, which may create an aesthetically pleasing hinge assembly 34. It will also be appreciated that the bin 20 provided herein may be utilized in any other appliance, cabinet 12, and/or furniture without departing from the scope of the present disclosure.

Figure 2:
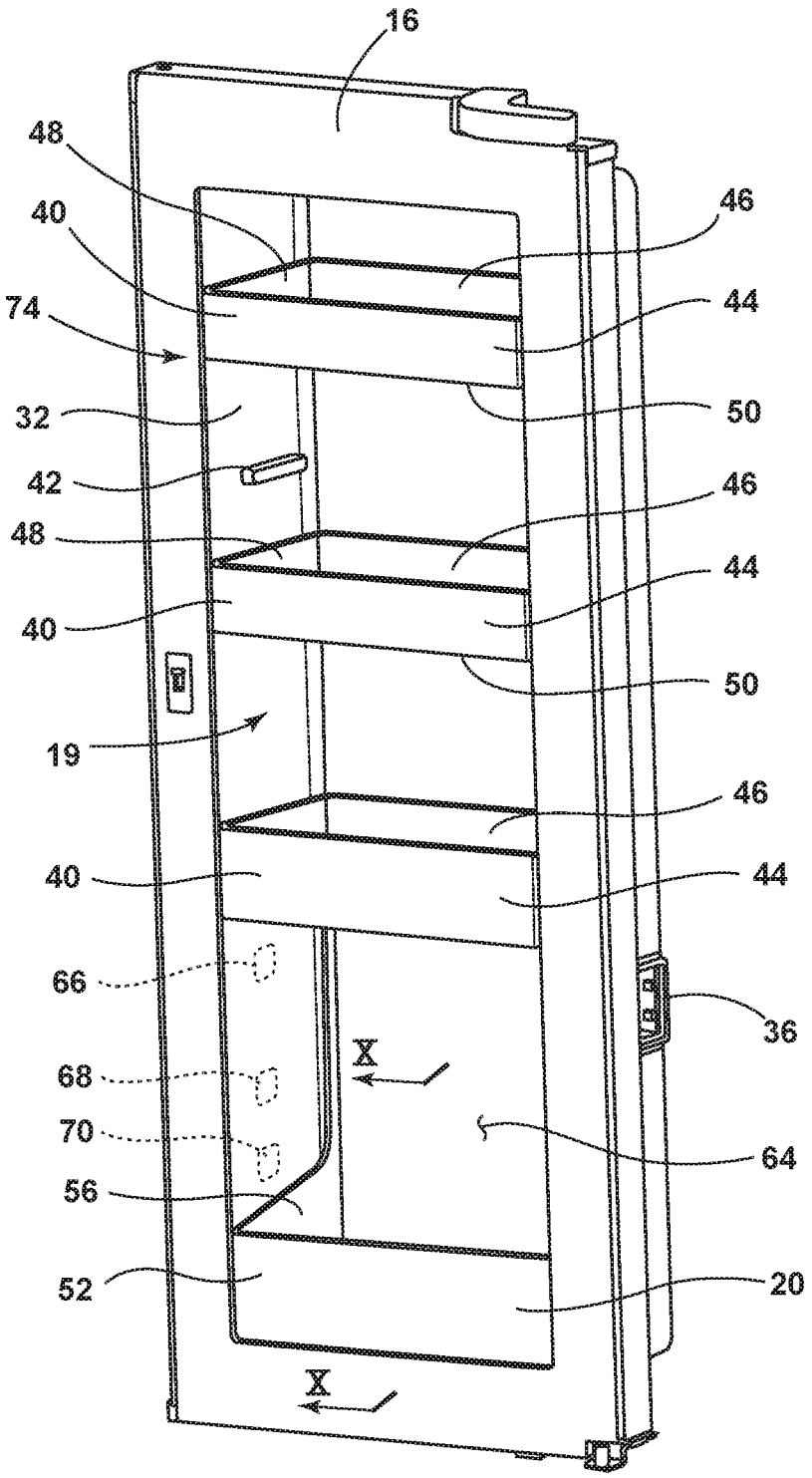
FIG. 2 is a front perspective view of the first door with the bin in a first, upright position, according to some examples.
Figure 3:
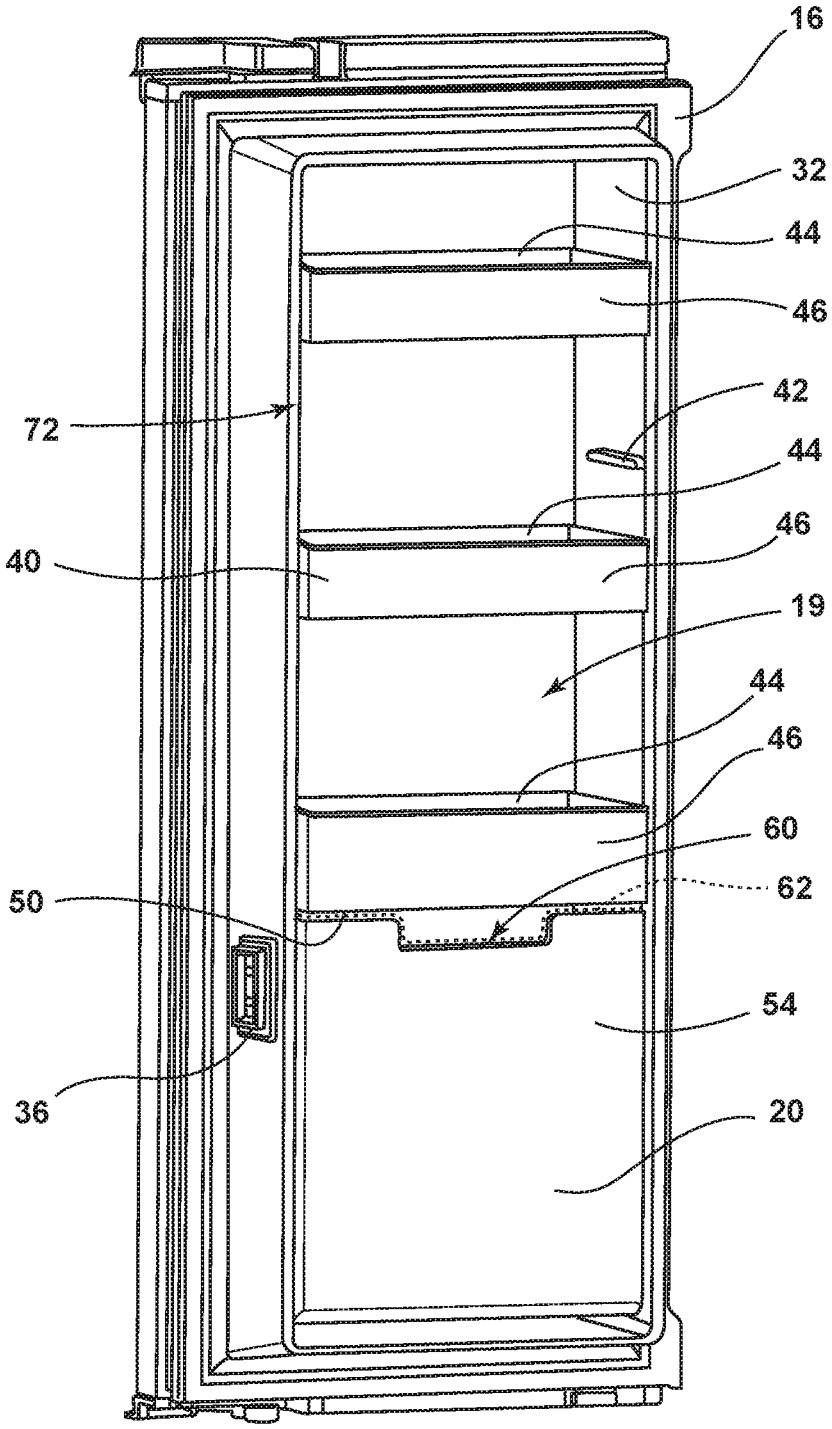
FIG. 3 is a rear perspective view of the first door with the bin in the first, upright position, according to some examples.

Referring to FIGS. 2 and 3, a front panel 44, a rear panel 46, a pair of opposing side panels 48, and a bottom panel 50 may define the tray 40. The trays 40 may be vertically adjustable through any means known in the art, such as, but not limited to, suspension of the trays 40 on notches 42 disposed on the interior door liner 32. Accordingly, the side panels 48 and/or bottom panel 50 of the trays 40 may include a corresponding attachment section that assists in maintaining the trays 40 in a substantially constant position within the chamber 19.

Figure 4:
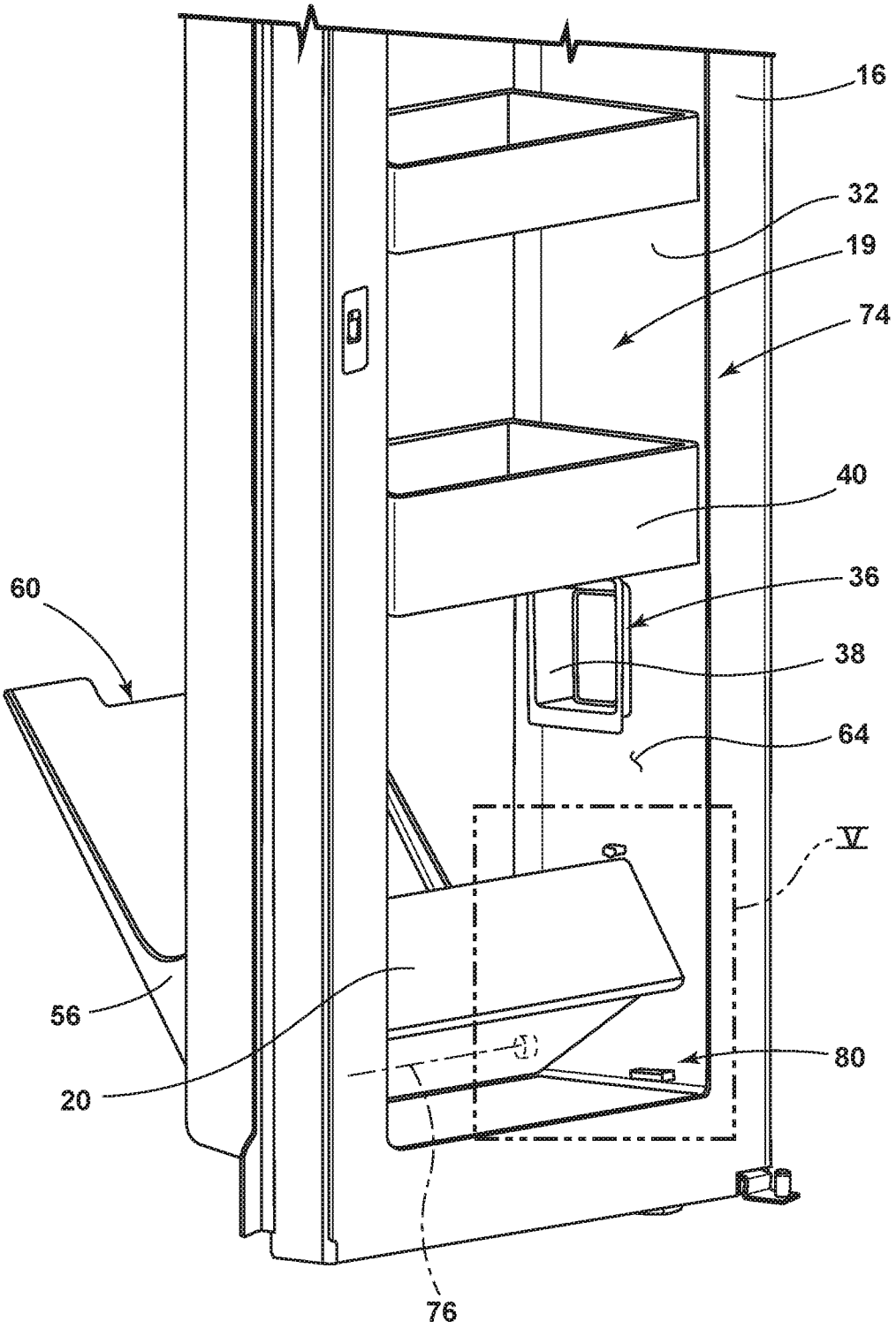
FIG. 4 is a partial front perspective view of the door with the bin in a second, rotated position, according to some examples.
Figure 10:
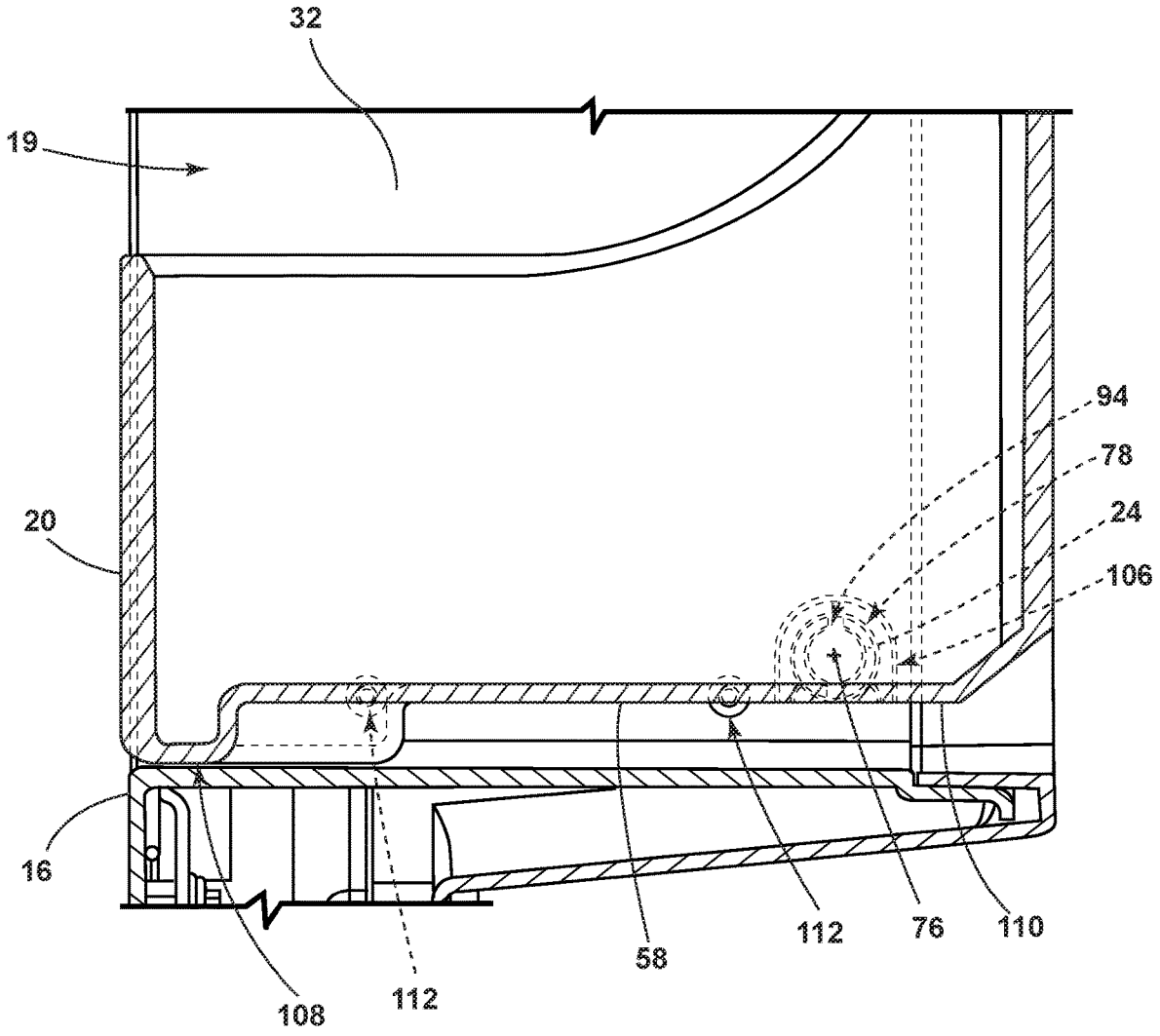
FIG. 10 is a cross-sectional view of the first door with the bin in the first position taken along the line X-X of FIG. 2.

The one or more bins 20 may be disposed within the chamber 19. A front surface 52, a rear surface 54, a pair of side surfaces 56, and a bottom surface 58 (FIG. 5) may define the bin 20. In some examples, the rear surface 54 may extend vertically above the front surface 52. Further, as shown in FIGS. 4 and 10, the bottom surface of the bin 20 may be spaced a predetermined distance from inner support wall of the door 16. In various examples, the bin 20 may also include a top surface that encloses the bin 20. In such examples, the bin 20 may be movable to provide access thereto.

The rear surface 54 may have a handle portion 60 defined therein and/or attached thereto. The bins 20 and trays 40 may be formed from any practical material. For example, the bins 20 and trays 40 may be formed from a polymeric material. Exemplary materials include polyethylene terephthalate, polyethylene, polyvinyl chloride, polycarbonate, polypropylene, acrylonitrile butadiene styrene, or other suitable materials. In some examples, an elastomeric material, a glass-based material, a metallic material, and/or a combination thereof may also be utilized in conjunction with, or in lieu of, the polymeric material. In some examples, the bins 20 and the trays 40 may be formed from a transparent and/or translucent material. Alternatively, any of the bins 20 and/or trays 40 may be formed from an opaque material. Alternatively still, some bins 20 and/or trays 40 may be transparent while other bins 20 and/or trays 40 may be opaque.

The rear surface 54 of the bin 20 may extend vertically upwards to a location in close proximity to the bottom panel 50 of the tray 40 disposed vertically above the bin 20. Accordingly, when the bin 20 is in a stowed position, a storage area 64 may be defined by the bin 20, the tray 40 disposed vertically above the bin 20, the interior door liner 32, and the second door 18. In various embodiments, a gasket 62 may be coupled with the rear surface 54. The gasket 62 may be disposed in close proximity to the tray 40.

In some examples, the storage area 64 may be operably coupled with the duct outlet 36 and/or the air baffle 38 (FIG. 4) for providing cooled air to the area. In some examples, humidity and/or temperature may be controlled within the storage area 64 to enhance the preservation of different food items. For instance, dairy products, meats, fruits, vegetables, and/or other desired items may be disposed within the enclosed storage area 64 within the chamber 19. The storage area 64 may be designed to be maintained at a temperature and/or humidity level that varies from other locations of the remainder of the fresh food compartment 14. Accordingly, a humidity sensor 66 and/or a temperature sensor 68 may be disposed within the storage area 64. A humidity system 70 may be operably coupled with the humidity sensor 66 for adjusting the humidity within the storage area 64.

Referring to FIGS. 3 and 4, the bin 20 may be rotatable from a first, upright position, as illustrated in FIG. 3, to a second, rotated position, as illustrated in FIG. 4. According to some examples, the bin 20 may be rotated to a position in which the rear surface 54 is disposed partially outwardly of, or externally from, the chamber 19. The rotation may occur once a user moves the first door 16 to the open position and desires to access an item within the bin 20 from the first side 72 of the chamber 19. In alternate examples, the bin 20 may be rotated such that the front surface 52 may be disposed outwardly of the chamber 19. The rotation may occur once a user moves the second door 18 to the open position and desires to access an item within the bin 20 from the second side 74 of the chamber 19. Alternatively still, in some examples, the bin 20 may be selectively rotated such that the rear surface 54 and the front surface 52 may be disposed outwardly of the chamber 19 when the first and/or second doors 16, 18 are rotated to the open position. The bin 20 may be movable about an axis 76 that is parallel to a bottom wall of the interior door liner 32. Moreover, the axis 76 may also be substantially transverse to the vertically extending sidewalls of the interior door liner 32.

Figure 5:
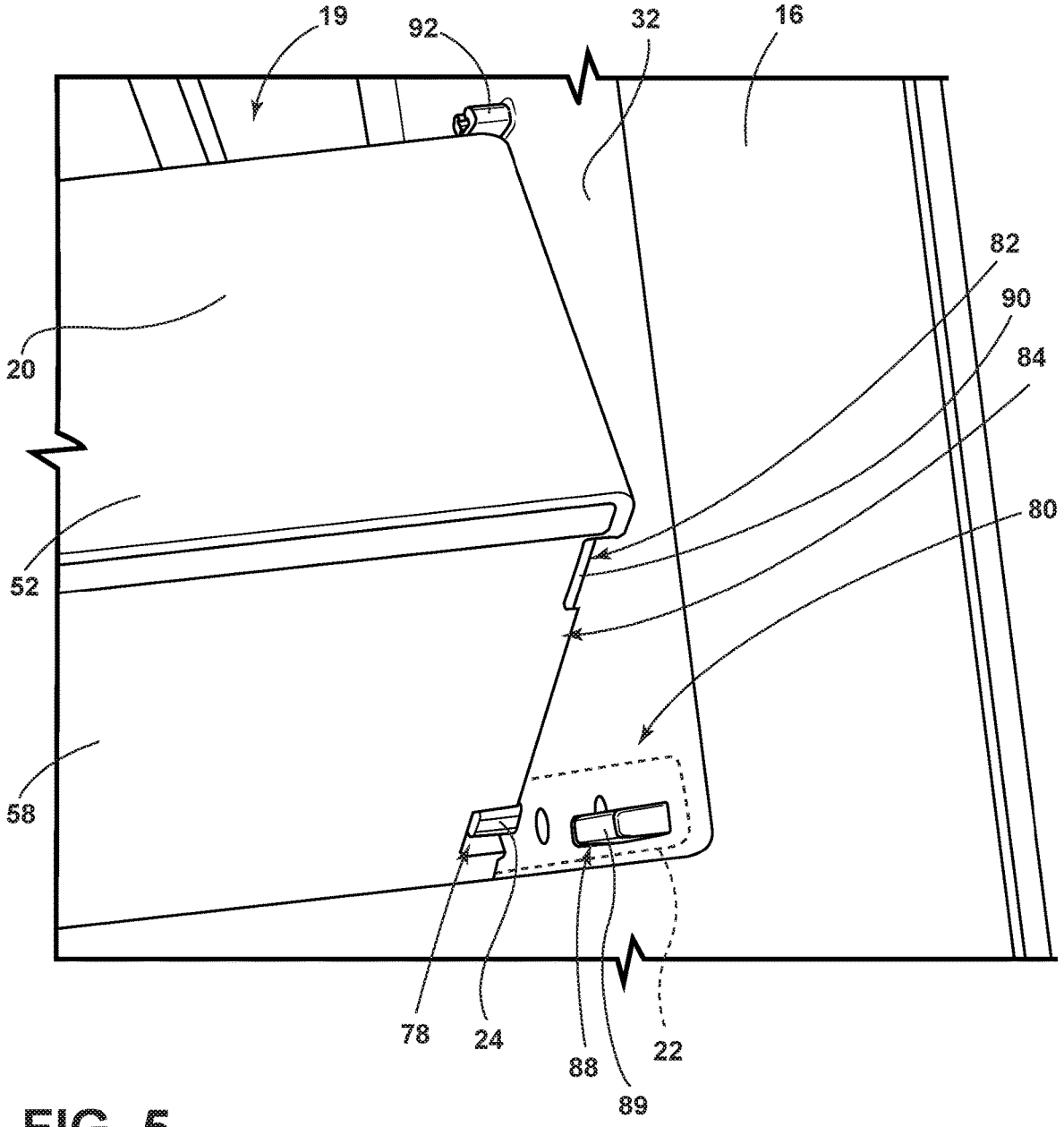
FIG. 5 is an enhanced view of area V of FIG. 4 illustrating the bin in the second position, according to some examples.
Figure 6:
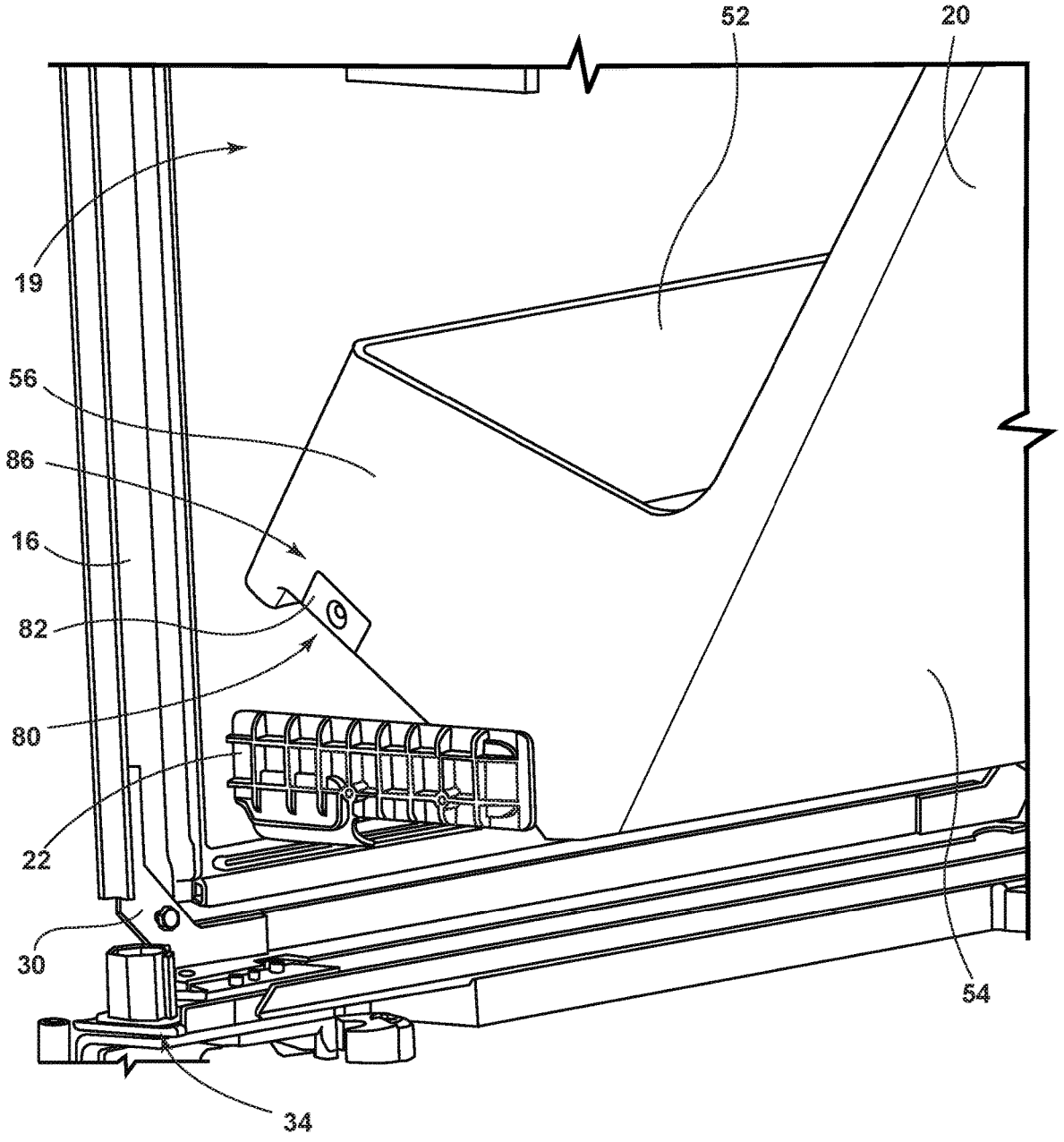
FIG. 6 is a rear partial perspective view of the bin in the second position, according to some examples.

Referring to FIGS. 5 and 6, in some examples, the bin 20 defines a cavity 78 into which a rotatable member 24 may be inserted. The rotatable member 24 may be tubular shaped and extend from a bracket 22 disposed on the first door 16. It will be appreciated, however, that the rotatable member 24 may be any device capable of moving the bin 20 between first and second positions.

Figure 7:
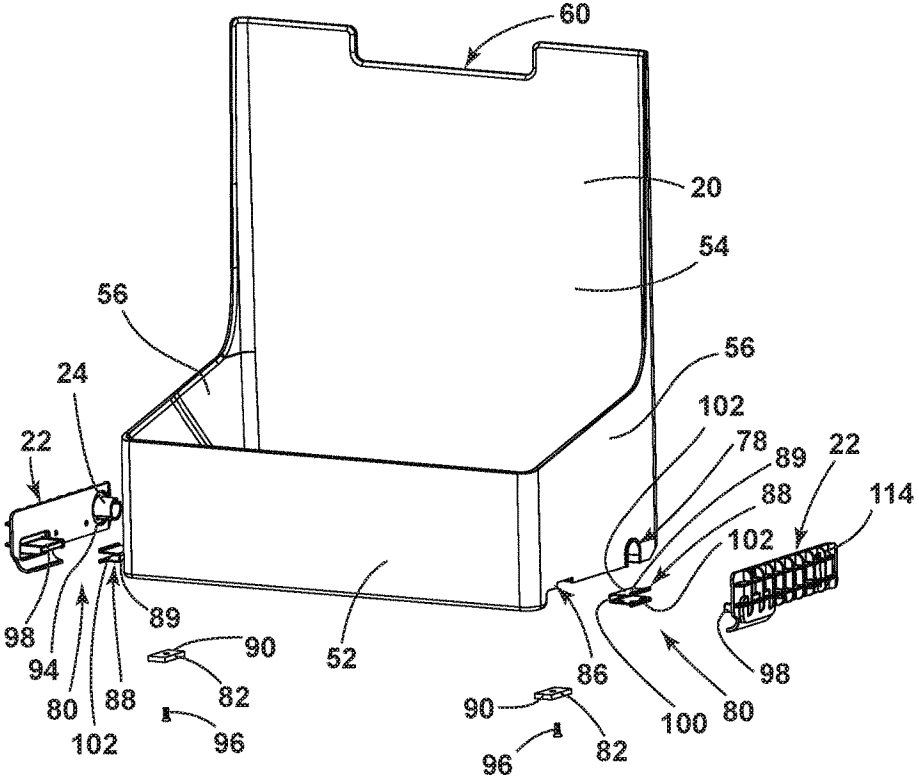
FIG. 7 is a front, exploded view of the bin and a bracket that cooperates with the bin to move the bin between the first and second positions, according to some examples.

A latch 80 may be configured to maintain the bin 20 in a desired position, such as the first, upright position. According to some examples, a coupling member 82 may be disposed on a bottom portion 84, a side portion 86, and/or any other portion of the bin 20 that is configured to interact with an attachment member 88. The attachment member 88 may be disposed on the bracket 22. According to some examples, the attachment member 88 may include a magnetically attractive material, such as a retainer 89 made of iron, or other magnetic material, which is mounted on the bracket 22. The coupling member 82 may include one or more magnets 90 carried on the bin 20 that may be attached to the bin 20 through any method known in the art, such as through the use of a fastener 96 (FIG. 7). While being relatively fixed, the coupling member 82 may be movable within a fixed range so that it is able to accommodate tolerances in the positioning of the bracket 22 and the attachment member 88 relative to the storage bin 20.

A stop 92 may project outwardly from the door interior liner. The stop 92 may be attached to the interior door liner 32. Additionally, and/or alternatively, the stop 92 may be integrally formed with the interior door liner 32. The stop 92 may interact with the bin 20 to define a fully rotated position of the bin 20. For example, one or more of the side surfaces 56 of the bin 20 may move upwardly as the bin 20 is rotated from the first position to the second position. The stop 92, which may be disposed on the interior door liner 32, is contacted by the one or more side surfaces 56 of the bin 20 to inhibit movement of the bin 20 past the stop 92. In some examples, the bin 20 and/or the stop 92 may be elastically deformable such that the bin 20 may be removed from the first door 16.

Figure 8:
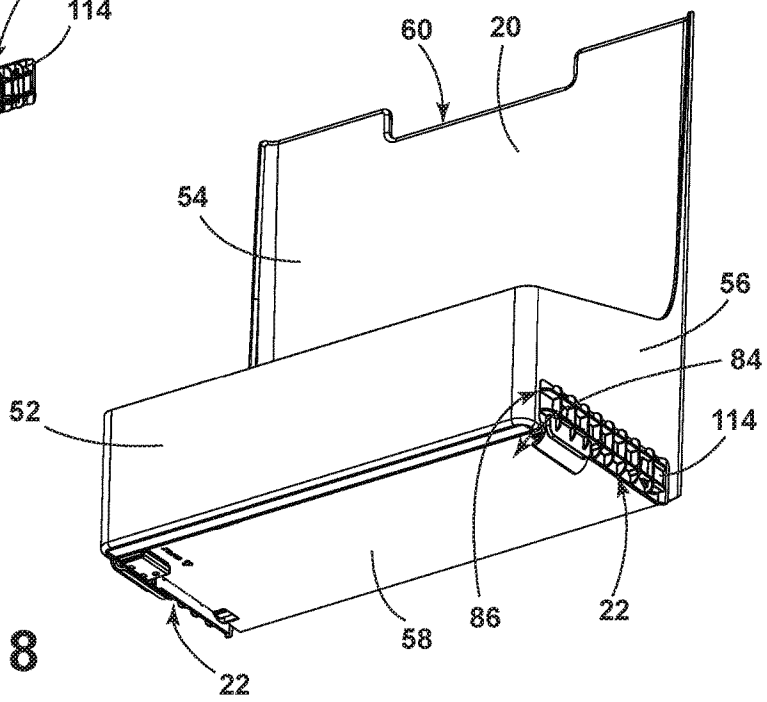
FIG. 8 is a bottom perspective view of the bin, according to some examples.

Referring to FIGS. 7 and 8, the bracket 22 may also include the rotational device that defines the rotational axis 76 (FIG. 4) of the bin 20 between the first position and the second position. According to some examples, the rotatable member 24 may have a tubular orientation including one or more slots 94. The rotatable device may be stationary with the bin 20 rotating about the stationary rotatable member 24 and/or the rotatable member 24 may rotate with the bin 20 being disposed on the rotatable member 24 in a substantially fixed manner. Alternatively still, the rotatable member 24 and the bin 20 may also rotate. The slots 94 may allow the rotatable member 24 to elastically deform as the bin 20 is disposed on the rotatable member 24 during assembly.

The bracket 22 further defines a projection 98. The projection 98 may be integrally formed with the bracket 22 and extend in a substantially transverse direction to the bracket 22. The retainer 89 may be disposed on the projection 98 and/or attached to the projection 98. According to some examples, a fastener and/or adhesives may be utilized for maintaining the retainer 89 on the projection 98. Additionally, and/or alternatively, the retainer 89 may be constructed in one piece and may be made of a resilient material such as metal, such as steel, or plastic or any other resilient material to present a unitary structure. The retainer 89 may include a base portion 100 and two opposing flanges 102. The flanges 102 may be compressively disposed on the flange 102 to maintain the retainer 89 in a substantially fixed position. In some examples, each flange 102 may include a barb 104 (FIG. 9) for further maintaining the retainer 89 on the projection 98.

In some examples, the attachment member 88 may include one or more magnets 90 carried on the bracket 22. In other examples, the magnet 90 may be carried on the storage bin 20 and the magnetic material may be carried on the bracket 22 and/or otherwise disposed within the chamber 19. The use of magnets 90 as the latch 80 retaining force allows the latch 80 to retain the storage bin 20 in the upright position within the chamber 19 during normal operation of the refrigerated appliance 10, but also allows for release between the first door 16 and the storage bin 20 when a user desires access to the bin 20 through the first side 72 of the chamber 19. Also, the use of magnets 90 allows for flush components, rather than projecting catch members, thereby eliminating the chance of objects being caught on the latch components.

Figure 9:
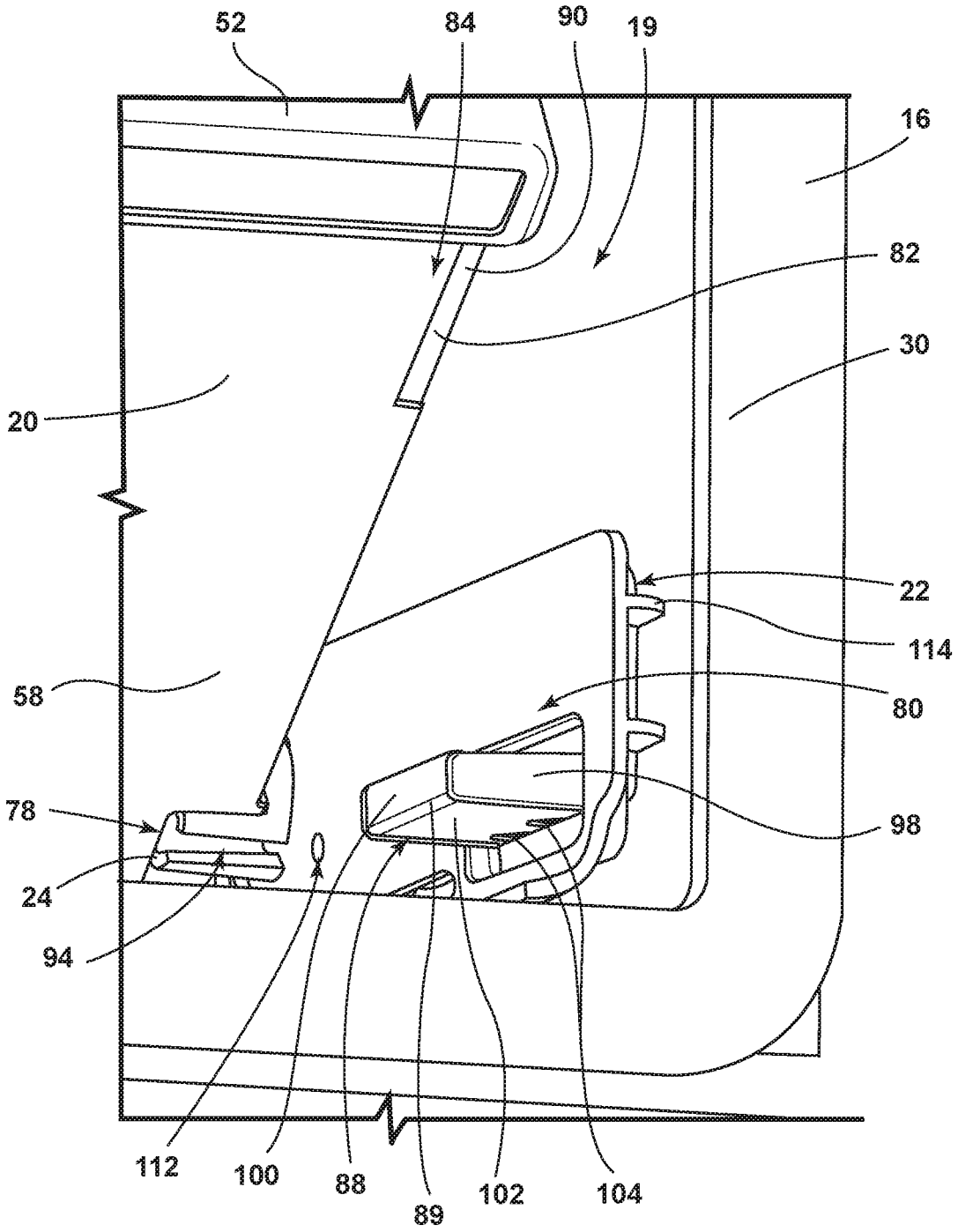
FIG. 9 is a partial front perspective view of the bin in the second position, according to some examples.

Referring to FIGS. 9 and 10, the bin 20 may be removably coupled with the rotational device. According to some examples, the bin 20 may define a cavity 78 that includes a curved portion 106. The curved portion 106 of the cavity 78 may interact with the rotational device to rotate the bin 20 about the predefined axis 76. The curved portion 106 may have a first diameter that is larger than a second diameter of the rotational device. A lower portion of the cavity 78 may be open such that the bin 20 may be removed therethrough.

With further reference to FIGS. 9 and 10, the bottom surface 58 of the bin 20 may include a forward portion 108 that defines a foot that is disposed vertically below a rearward portion 110 of the bottom surface 58 and/or the cavity 78. In some examples, the forward portion 108 may contact the interior door liner 32 in the first position. Moreover, when the forward portion 108 is in contact with the interior door liner 32, a central portion of the bottom surface 58 may be substantially horizontal. However, it will be appreciated that the bottom surface 58 may have any desired orientation while the bin 20 is in the upright, first position, the rotated, second position, and/or any intermediate position.

Referring still to FIGS. 9 and 10, the bracket 22 and/or rotatable member 24 may be fixed to the first door 16 through any practicable method, such as through the use of a fastener. Moreover, one or more fixation points 112 may be defined by the interior door liner 32 for disposing the fastener therein. In examples in which the interior door liner 32 includes a plurality of fixation points 112, the bracket 22, and the bin 20, may be coupled to a plurality of positions within the chamber 19. The bracket 22 may include one or more ribs 114 on a rear surface thereof. The ribs 114 may assist in increasing weight bearing characteristics of the bracket 22, as well as anti-torqueing characteristics of the bracket 22, as the bin 20 is supported by the bracket 22 and/or moved between the first and second positions.

Figure 11:
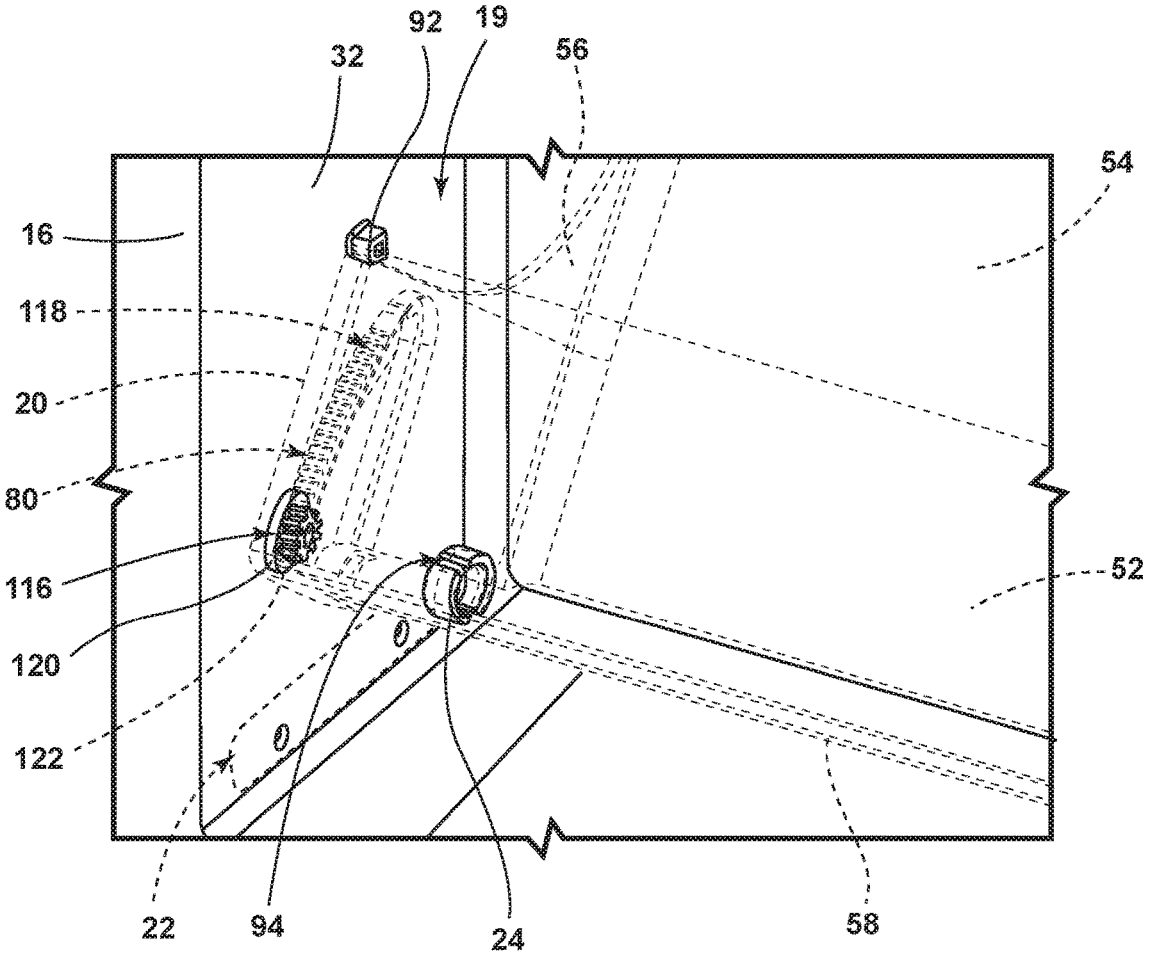
FIG. 11 is a front perspective view of the first door and the bin in the second position with a dampener disposed between the bin and the first door.

Referring to FIG. 11, a damper 116 may secure the bin 20 in the first position, the second position, and/or an intermediate position. The damper 116 may maintain the bin 20 in a substantially constant position when the first door 16 is opened, and in some instances, when the first and/or the second doors 16, 18 are opened rapidly. The damper 116 may be mounted on the first door 16 and can be arranged to engage curved rack 118 that can be positioned on the bin 20. The curvature of the rack 118 can be arranged so that the damper 116 can engage the rack 118 as the bin 20 moves between the first, upright position and the second, rotated position. According to some examples, the damper 116 can be a fluid damper. The damper 116 can include a gear 120 that can be connected to a disk contained in a housing containing a viscous fluid. Rotation of the gear 120 can rotate the disk in the viscous fluid so that the damper 116 can slow the movement of the bin 20 to provide a smooth steady opening and closing motion of the bin 20. In addition, the damper 116 can form the latch 80.

Those skilled in the art will appreciate that the damper 116 can be other damper arrangements including pneumatic, hydraulic, and mechanical dampers instead of a viscous damper 116 described above. In operation, a user can grasp the handle to move the bin 20 between the first and second positions. The damper 116 can allow the bin 20 to move smoothly between positions without opening or closing hard. Those skilled in the art will understand that the bin 20 can also be provided with a spring biased push-push latch 80 so that the bin 20 can be released from the first position by pressing on the bin 20 to release the bin 20 and allow the bin 20 to move to the second position under the control of the damper 116. While the damper 116 is shown connected between the first door 16 and the side surface 56 of the bin 20, those skilled in the art will understand that a damper 116 can be mounted and connected as desired to smooth the motion of the bin 20. The bin 20 described herein can be provided with a damper 116 to improve a user's experience with the bin 20 and also to help prevent accidental opening of the bin 20 as the first door 16 is moved between open and closed positions.

Use of the bin provided herein may offer several advantages. For example, by utilizing the disclosed bin, the bin may be accessible from two opposing sides thereof. Additionally, the bin provided herein may form an independent storage area within a compartment or chamber of the refrigerated appliance. The bin may provide easy access to items stored therein. Additionally, the bin may provide a barrier when closed, keeping a colder environment inside the storage area and may still be accessible from both sides. Moreover, a latch may allow the bin to be maintained in a desired position as a door of the refrigerated appliance is moved between closed and open positions. The bin may be manufactured at low costs and increase storage volume of the refrigerated compartment when compared to various crisper assemblies and/or other storage assemblies currently disposed within refrigerated appliances.

It will be understood by one having ordinary skill in the art that construction of the described invention and other components is not limited to any specific material. Other exemplary examples of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A refrigerated appliance comprising:

a cabinet defining a compartment;

a door coupled to the cabinet, wherein the door includes an interior door liner and defines a storage chamber therein;

a bracket coupled to the interior door liner of the door, the bracket including a rotatable member including a damper and a retainer extending outwardly from the interior door liner;

a bin operably coupled to the rotatable member and configured to rotate between an upright position and a rotated position and including a coupling member defined by a bottom surface of the bin and selectively coupled to the retainer, wherein the retainer is configured to support the bottom surface of the bin; and a magnet disposed on at least one of the retainer and the coupling member, wherein the magnet is configured to resist separation of the retainer with the coupling member thereby resisting rotation of the bin.

2. The refrigerated appliance of claim 1, further comprising a foot disposed vertically below a front portion of the bin, wherein the foot spans the bottom surface of the bin a predetermined distance above a wall of the door.

3. The refrigerated appliance of claim 2, wherein the bin defines a cavity and the rotatable member is partially disposed within the cavity.

4. The refrigerated appliance of claim 2, wherein a rear surface of the bin extends vertically above a front surface of the bin.

5. The refrigerated appliance of claim 1, wherein one of the retainer and the coupling member includes a magnet and the other of the retainer and the coupling member includes a magnetically attractive material retainer.

6. The refrigerated appliance of claim 5, wherein the bracket includes a projection and the retainer is disposed on the projection.

7. A refrigerated appliance comprising:

a cabinet defining a compartment;

a first door coupled to the cabinet, wherein the first door defines a storage chamber therein;

a rotatable member coupled to a side wall of the first door;

a projection extending from an interior door liner of the first door;

a second door coupled to the first door;

a bin disposed within the storage chamber and accessible from a first side when the first door is disposed in an open position and a second side when the second door is disposed in an open position, wherein the bin is selectively coupled to the projection and rotatable about the rotatable member between a first position and a second position, wherein the projection is configured to support a bottom surface of the bin in the first position; and a magnet disposed on one of the bottom surface of the bin and the projection, wherein the magnet is configured to resist separation of the bottom surface of the bin and the projection thereby resisting rotation of the bin.

8. The refrigerated appliance of claim 7, wherein the bin is disposed within the chamber in the first position and partially externally from the chamber in the second position.

9. The refrigerated appliance of claim 7, wherein the bin includes a front surface defining a foot.

10. The refrigerated appliance of claim 7, further comprising:

a bracket operably coupled with the first door and including the rotatable member thereon.

11. The refrigerated appliance of claim 10, wherein the bin defines a cavity and the rotatable member is disposed within the cavity.

12. The refrigerated appliance of claim 7, further comprising:

a stop on the first door, wherein the bin contacts the stop when the bin is disposed in the second position.

13. The refrigerated appliance of claim 10, wherein the magnet on one of the bottom surface of the bin and the protrusion interacts with a magnetically attractive material retainer on the other of the bottom surface of the bin and the protrusion.

14. A bin assembly for an appliance comprising:

a rotatable bin configured to be disposed within a first door of said appliance;

a stop extending outwardly from a door liner of the first door and configured to selectively engage the rotatable bin in an open position of the rotatable bin;

a cavity defined by the bin and configured to accept a rotatable member therein;

a curved rack operably coupled to the rotatable bin and configured to selectively maintain a predefined position of the rotatable bin; and a latch configured to maintain the bin in the predefined position, wherein the latch includes a damper operably coupled to the curved rack and coupled to the first door of said appliance and configured to selectively maintain the bin in the predefined position, wherein a bottom surface of the bin is spaced a predetermined distance from an inner support wall of the door.

15. The bin assembly of claim 14, wherein a first portion of the latch includes a magnet on the bin and a second portion of the latch includes a magnetically attractive material retainer on a bracket.

16. The bin assembly of claim 14, wherein the bin includes a front surface defining a foot.

17. The bin assembly of claim 14, further comprising:

a gasket disposed along a rear surface of the bin.

18. The bin assembly of claim 14, wherein the bin is accessible from two opposing sides of an appliance door.

* * * * *